US005277087A

United States Patent [19]

Wilson, Jr. et al.

[11] Patent Number: 5,277,087

[45] Date of Patent: Jan. 11, 1994

[54] SOCKET AND DRIVE ASSEMBLY

[75] Inventors: David Wilson, Jr., Boulder; Lawrence M. Gardner, Arvada, both of Colo.

[73] Assignee: Swearless Tools Corporation, Boulder, Colo.

[21] Appl. No.: 43,593

[22] Filed: Apr. 5, 1993

Related U.S. Application Data

[63] Continuation of Ser. No. 874,094, Apr. 27, 1992, abandoned, which is a continuation-in-part of Ser. No. 706,378, May 28, 1991, abandoned.

[51] Int. Cl.[5] ..... B25B 17/00

[52] U.S. Cl. ..... 81/57.29; 81/57.46; 81/58.2

[58] Field of Search ..... 81/57.13, 57.29, 57.3, 81/57.46, 58.2

[56] References Cited

U.S. PATENT DOCUMENTS

| | | | |
|---|---|---|---|
| 1,346,716 | 7/1920 | Lee . | |
| 2,712,256 | 7/1955 | Fish . | |
| 2,712,257 | 7/1955 | Fish . | |
| 2,758,493 | 8/1956 | Goldwater | 81/58.2 |
| 3,564,955 | 2/1971 | Batchelder . | |
| 3,668,949 | 6/1972 | Walker | 81/57.46 X |
| 3,742,779 | 7/1973 | Shaver . | |
| 4,374,479 | 2/1983 | Minotti | 81/57.3 |
| 4,685,848 | 8/1987 | Langer | 81/57.29 X |
| 4,914,987 | 4/1990 | Isler | 81/57.46 |

FOREIGN PATENT DOCUMENTS

| | | |
|---|---|---|
| 3504843 | 2/1985 | Fed. Rep. of Germany . |
| 3523781 | 3/1985 | Fed. Rep. of Germany . |
| 8526562.4 | 9/1985 | Fed. Rep. of Germany . |

*Primary Examiner*—James G. Smith
*Attorney, Agent, or Firm*—Harold A. Burdick

[57] ABSTRACT

A socket engageable with a drive assembly is disclosed, the socket having two segments pivotably connected with each having an engageable periphery for rotation of the socket by the drive assembly and together defining a center bore for engaging a work piece, the segments being self locking when the work piece is engaged. The drive assembly has a selectively accessible slot for receiving and holding the socket in the operative position, a mating drive gear for the rotation of the socket and a guide for assuring lateral and rotational stability of the socket.

19 Claims, 6 Drawing Sheets

46
66
20B
17
22

20A
66'
18
60
64
62
24B
24A
16
63
15
40

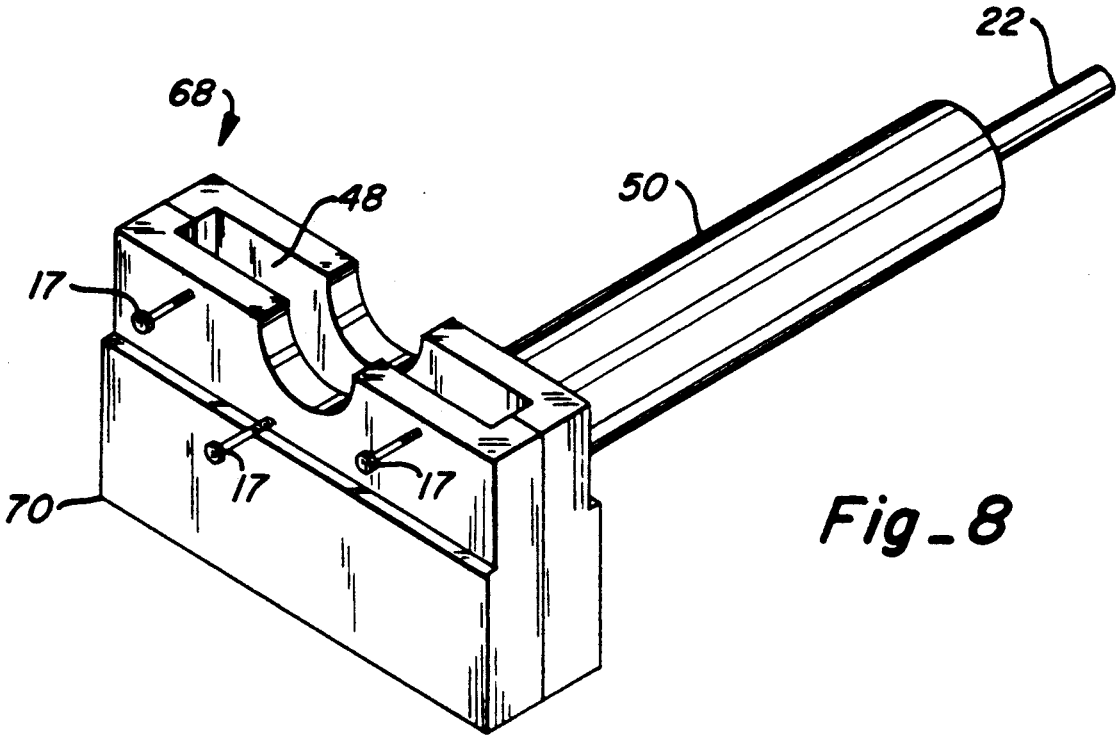
Fig_8
Fig_9
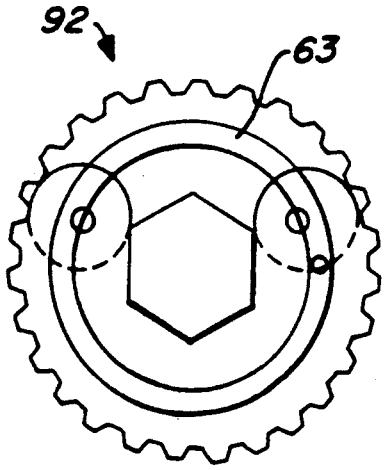

Fig_10
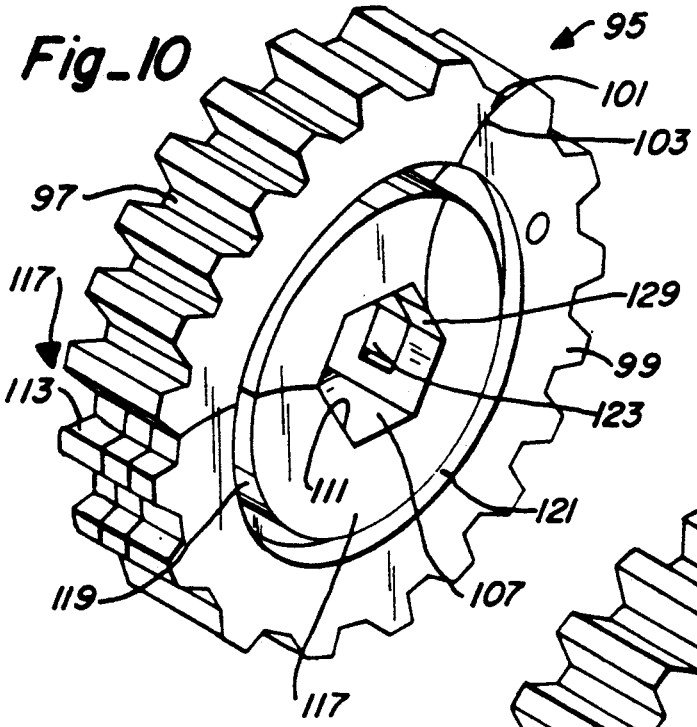
Fig_11A
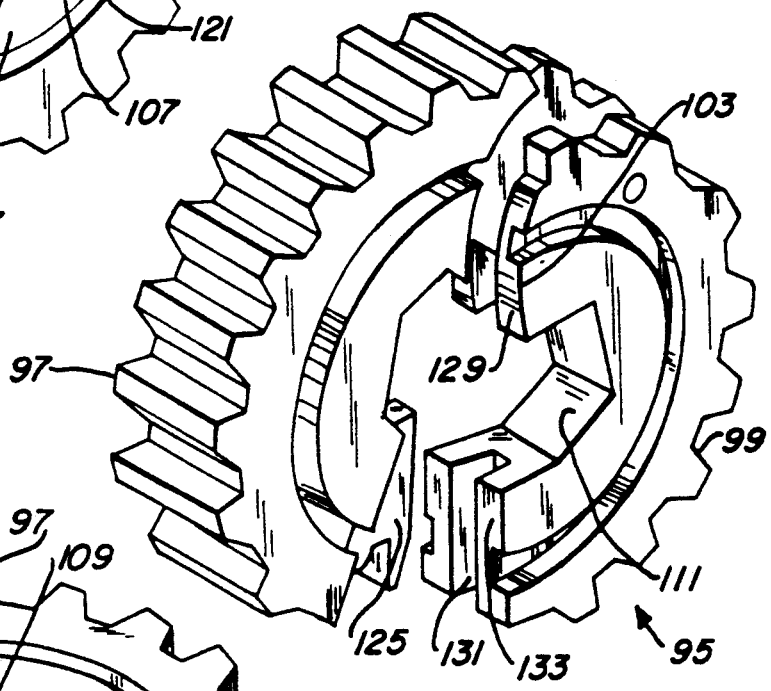
Fig_12
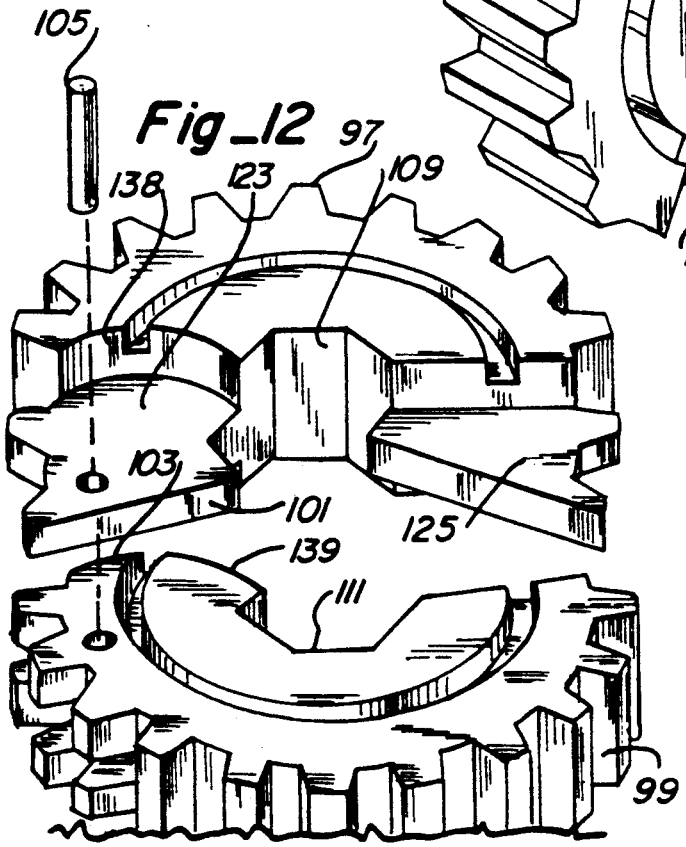
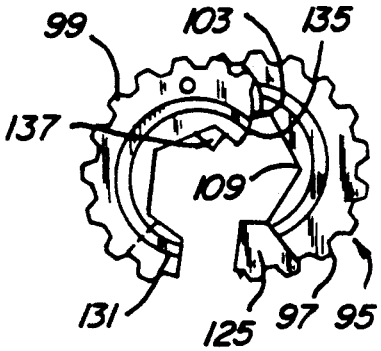
Fig_11B

Fig_13
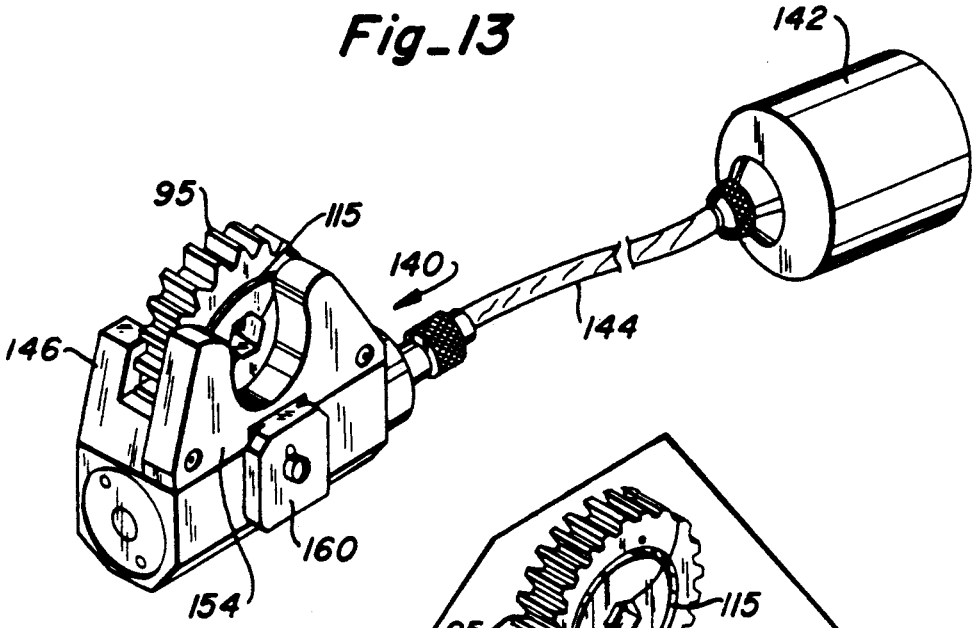
Fig_14A
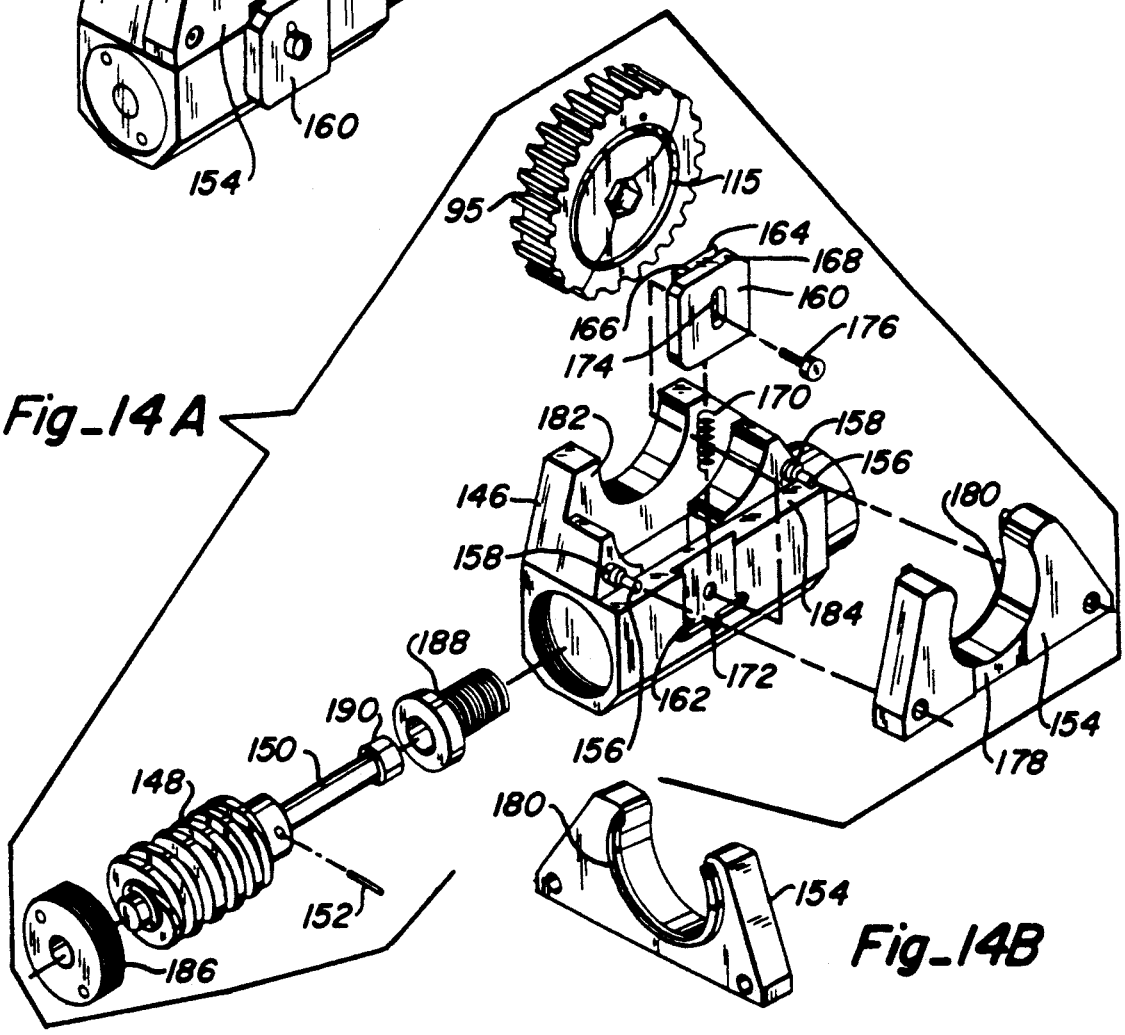
Fig_14B

SOCKET AND DRIVE ASSEMBLY

RELATED APPLICATION

This application is a continuation of Ser. No. 07/874,094 filed Apr. 27, 1992, abandoned, which is a continuation-in-part of now pending application Ser. No. 07/706,378 filed on May 28, 1991, abandoned, and entitled "Peripheral Driven Composite Sockets And Drive Wrenches".

FIELD OF THE INVENTION

This invention relates to sockets and wrenches, and, more particularly, relates to peripherally driven sockets and associated drive mechanisms.

BACKGROUND OF THE INVENTION

In the manufacture and maintenance of aircraft, heavy equipment, machinery and appliances it is often necessary to remove and install hoses, lines and pipes that are attached to fittings by a threaded fastener (for example, a flare nut, B nut, or the like). Moreover, such equipment and machinery may often utilize a plurality of conduits that are placed close together, in confined or otherwise hard to access spaces, or at awkward angles.

These threaded fasteners, therefore, must often be rotated with open end wrenches and various types of pliers, risking damage to the fastener and providing only a slow manual manipulation of the fastener and little or no means for limiting the torque delivered to the fastener. Removal and installation of threaded fasteners on the various forms of conduit may thus be slow and tedious.

Several types of wrenches to rotate such fasteners in such a way as to make the process faster and cause less damage to the fastener have been heretofore suggested and/or utilized. U.S. Pat. Nos. 2,712,256, 2,712,257, and 2,758,493 disclose open ratchet wrenches which can turn a hex fastener encircling a line. U.S. Pat. Nos. 3,564,955, 3,668,949, 4,914,987, and 4,374,479 disclose gear driven tools for rotating fasteners or appliances that hold such fasteners.

These tools, however, suffer from many of the same problems as open end wrenches (such as the ratchet wrenches described above), in that when a plurality of hoses, lines or pipes are clustered together or are close to accessories of the equipment being worked on it is very difficult to find enough room to manipulate the tool in such a way as to engage and operate the tool. In addition, many such tools are unduly complex and/or are configured in such a way that they can slip off the fastener and cause damage to the fastener, the tool and/or the user.

Of those tools described above utilizing geared peripheries, some have utilized a single divided collet as a holder for nut rotating accessories thus practically negating use for flare nuts on continuous lengths of conduit (i.e., such tools, while providing a collet that can be split and opened to grip accessories, have not provided accessories that can be split and opened to encircle the length of conduit), and have not provided for their use with an assortment of interchangeable sockets for different applications. Often, complex closing and locking procedures are required which limit the applications and/or complicate usage of such tools.

SUMMARY OF THE INVENTION

This invention provides an improved peripherally driven socket and drive assembly for manipulating a work piece such as a fastener, the invention being compact and particularly useful for fasteners associated with continuous lengths of conduit. The socket can be opened and closed, for example around a conduit, positioned on the fastener and then rotated by a drive assembly, the socket preferably being closable without direct user intervention and self locking once positioned on the fastener.

The socket includes first and second parts having inner edges configured to abut the work piece, the parts being pivotably connected adjacent to first ends thereof and having projecting and receiving portions at the other ends thereof which are engageable in the closed position. The connection of the parts is preferably located so that portions of the inner edges, when abutting the work piece, overlap sufficiently to substantially preclude relative pivotal movement of the parts, and is preferably configured so that one of the first ends defines a lever portion for causing relative pivotal movement of the parts when acted upon, for example when brought to bear against a length of conduit thus moving one of the parts to the closed position.

The drive assembly is configured to accommodate reception of a socket without disassembly of the drive assembly and securement and proper positioning of the socket for rotation thereof, and includes a housing, a driving gear mounted in the housing, and means for positioning the socket mounted at the housing. The means for positioning the socket is preferably retractably mounted with the housing on a guide and is biased for urging movement in one direction on the guide.

It is therefore an object of this invention to provide an improved peripherally driven socket and drive assembly.

It is another object of this invention to provide a socket and drive assembly for manipulation of fasteners that encircle elements of continuous conduit and that require no necessity for travel of the drive assembly in order to rotate the fastener.

It is still another object of this invention to provide a socket which can be opened and closed with portions being engageable in the closed position.

It is yet another object of this invention to provide a peripherally driven socket that can be quickly opened, positioned around an element of conduit, closed thereafter without direct user intervention, and positioned and consequently secured around a fastener for rotation thereof.

It is another object of this invention to provide a drive assembly for a peripherally driven socket which is configured to receive, secure and properly position the socket for rotation thereof, all without disassembly of the drive assembly.

It is still another object of this invention to provide a socket engageable with a drive assembly for manipulating a work piece, the socket including a first part having an inner edge configured to abut the work piece and first and second ends, the first end having a projecting portion formed thereat, a second part having an inner edge configured to abut the work piece and first and second ends, the first end having a receiving portion formed thereat, and a pivot connecting the first and second parts at a location adjacent to the second ends for accommodating relative movement of the parts between an open position and a closed position with the projecting portion of the first end of the first part engaged by the receiving portion of the first end of the second part.

It is yet another object of this invention to provide a socket engageable with a drive assembly for manipulating a work piece, the socket including a first part having an inner edge at least a first portion at one end and a second portion of which are configured to abut the work piece, and a second part having an inner edge at least a first portion at one end of which is configured to abut the work piece, the first and second parts being pivotably connected at a location adjacent to the ends so that the first portions of the edges, when abutting the work piece to be manipulated, overlap sufficiently to substantially precluded relative pivotal movement of the parts.

It is another object of this invention to provide a drive assembly for a socket engageable with the drive assembly having a housing, means for driving the socket mounted in the housing, and means for enabling reception at the housing of the socket without disassembly of the drive assembly and securing and properly positioning the socket at the housing for rotation thereof.

It is still another object of this invention to provide a drive assembly for a peripherally driven socket which is compact, and which includes a retractable means for receiving and positioning the socket.

With these and other objects in view, which will become apparent to one skilled in the art as the description proceeds, this invention resides in the novel construction, combination and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate complete embodiments of the invention according to the best mode so far devised for the practical application of the principles thereof, and in which:

FIG. 8 is a perspective view of a second embodiment of the drive assembly of this invention;

FIG. 9 is a side view of a third embodiment of the socket of this invention;

FIG. 10 is a perspective view of a fourth embodiment of the socket of this invention;

FIG. 11A is a perspective view of the socket of FIG. 10 in the open position;

FIG. 11B is a side view of the socket as illustrated in FIG. 11A;

FIG. 12 is an exploded view of the socket of FIG. 10;

FIG. 13 is a perspective view of a third embodiment of the drive assembly of this invention;

FIG. 14A is an exploded view of the drive assembly of FIG. 13 with the socket of FIG. 10; and FIG. 14B is a perspective view of the positioning member of the drive assembly of FIG. 13.

DESCRIPTION OF THE INVENTION

Figure 1:
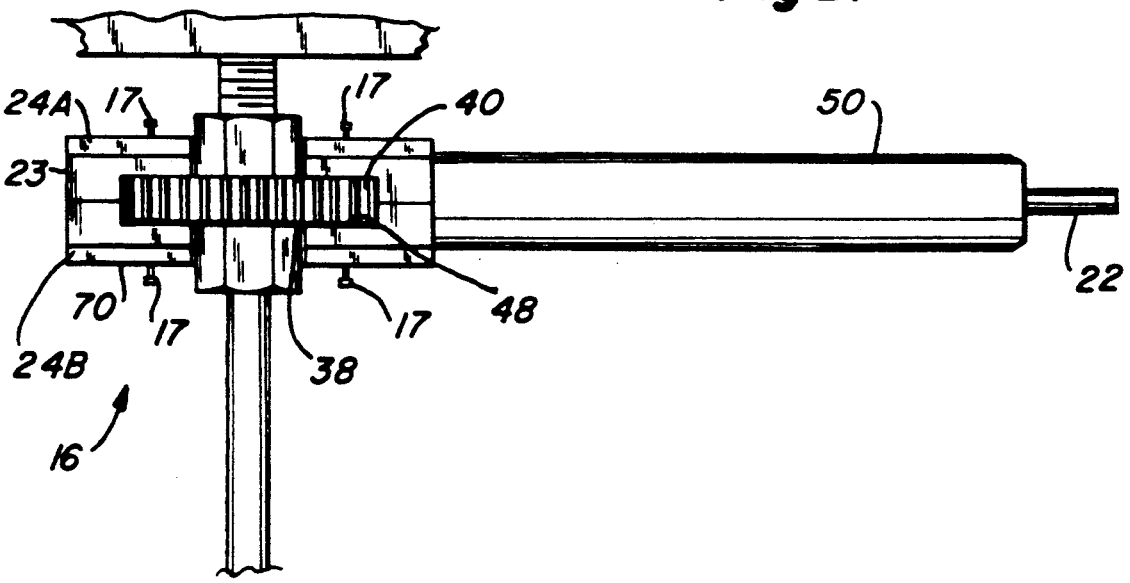
FIG. 1 is a top view of a socket of this invention encircling a fitting mounted on a conduit, with a first embodiment of the drive assembly engaged with the socket.
Figure 2:
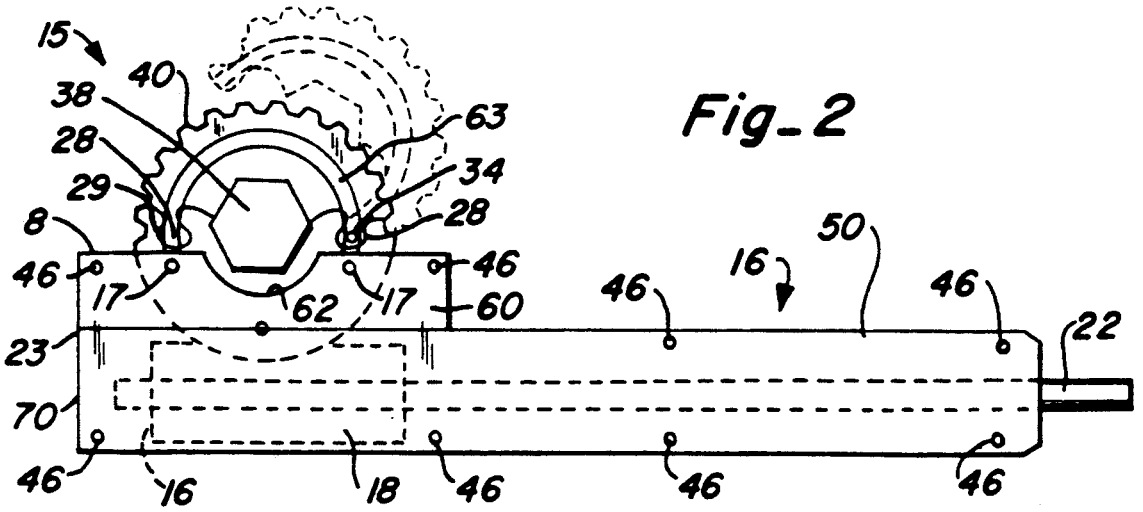
FIG. 2 is a side view of the drive assembly of FIG. 1 with a first embodiment of the socket engaged therein.
Figure 4:
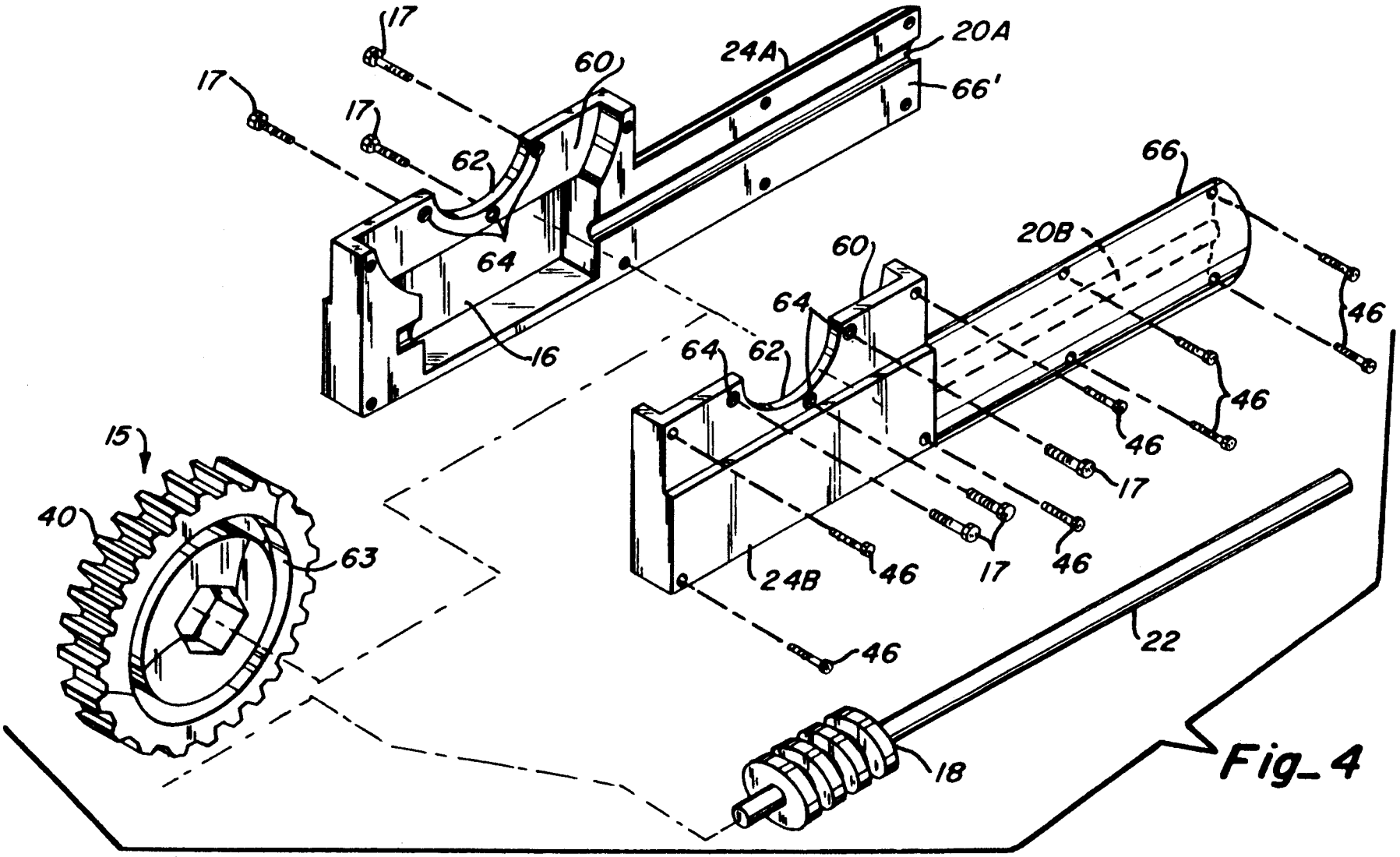
FIG. 4 is an exploded view of the drive assembly of FIGS. 1 and 2.

This invention includes a wrench unit, or drive assembly, and a peripherally driven composite socket. A first embodiment 16 of the drive assembly of the present invention is illustrated in FIGS. 1, 2 and 4 and comprises casing, or housing, 23 made in two halves 24A and 24B and secured together by any suitable means such as screws 46. If screws are used, casing half 24A is threaded, but otherwise the two halves are identical, each half having an outwardly projecting rectangular member 60 provided with a semicircular bore 62 and forming slot 48 when assembled.

At each side of slot 48 threaded holes 64 are provided in casing halves 24A and 24B for receipt of threaded boss projections 17. The boss projections may be provided with spring pressed balls (not shown) or the like, and cooperate with circumferential undercut guide channel 63 of composite socket 15 so that sockets are receivable and interchangeable without disassembly of the drive assembly, and are rotatable, guided, and held securely in alignment during use.

Slot 48 is in communication with rectangular chamber 16 in which worm gear 18 is rotatably mounted for engagement of worm toothed annulus 40 of the interchangeable socket 15 when in the operative position as illustrated in FIG. 2. Inner channels 20A and 20B of handle body halves 66 and 66 of casing halves 24A and 24B, respectively (shown in FIG. 4), receive shaft 22, one end of which has worm gear 18 thereat, while the other end of shaft 22 is adapted for connection to a driving gear and projects beyond the end of handle 50. As illustrated, the shaft is cylindrical to provide a secure coupling for a wrench, electric drill, or robotic arm, the actual source of rotation being any appropriate mechanical or electrical driving mechanism.

In a second embodiment 68 of the wrench, or drive assembly, of this invention illustrated in FIG. 8, head 70 of the wrench is transversely mounted to handle 50 and utilizes a socket with a spur geared periphery in driving mesh with a spur toothed drive gear attached to shaft 22.

Figure 5:
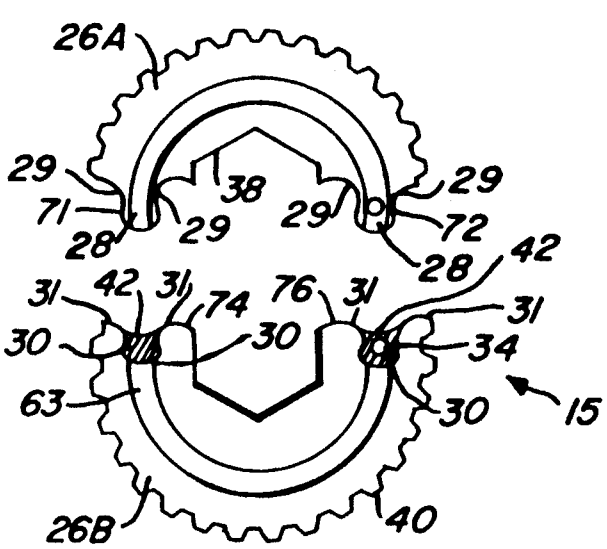
FIG. 5 is a partial exploded view of the socket of FIG. 2.
Figure 3:
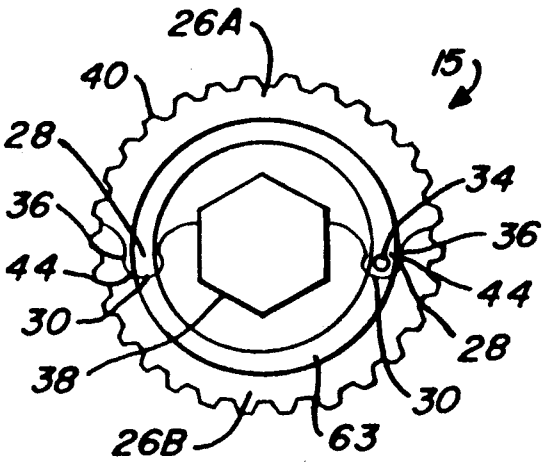
FIG. 3 is a side view of the socket in FIG. 2.
Figure 6:
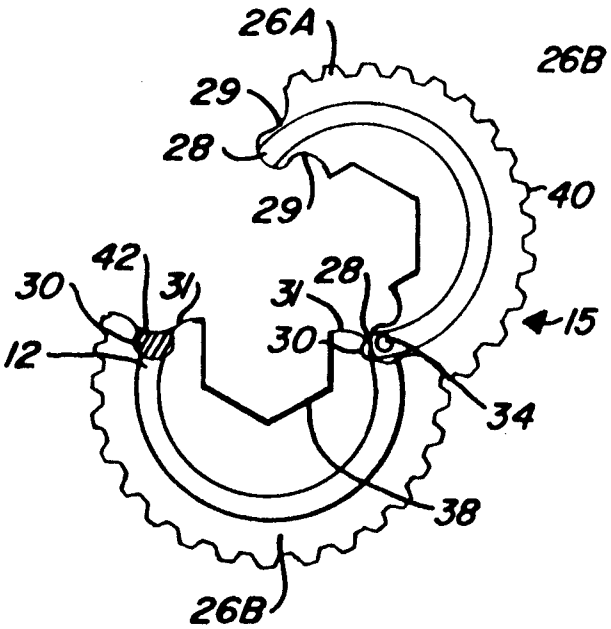
FIG. 6 is a side view of the socket of FIG. 2 in the unlocked and open position.

A first embodiment 15 of the peripherally driven composite socket of the present invention is illustrated in FIGS. 3, 5 and 6. Two segments, or parts, 26A and 26B are shaped either with male arcuate projections 28 or female arcuate receivers 30. The male projections are formed with an arcuate convex projecting head with two arcuate concave supporting shoulders 29 at the base of the projecting head throughout one half of the thickness of segment 26A on each of its ends 71 and 72. Each female receiver of segment 26B is machined with an arcuate concave slot at each segment end 74 and 76 with a plurality of arcuate convex supporting shoulders 31 throughout one half of the segments thickness, thus providing entrapments for male projections 28 while enabling mounting of pivot 34.

End 76 at receiver 30 and projection 28 at end 72 are drilled and have pivot 34 installed for alignment of arcuate segments 26A and 26B. By forming the male projections and the female receivers in this fashion, the projections and receivers entrap and interlock with each other (at 36 in FIG. 3) to form the peripherally drivable socket. Bore 38 of the socket is provided (herein with a hexagonal shape, though any needed geometry may be provided) for the engagement and rotation of a work piece, such as a fastener. Outer spur or worm geared annulus 40 is maintained in complementary relation by the interlocking of the projections and receivers of segments 26A and 26B, respectively.

Figure 7:
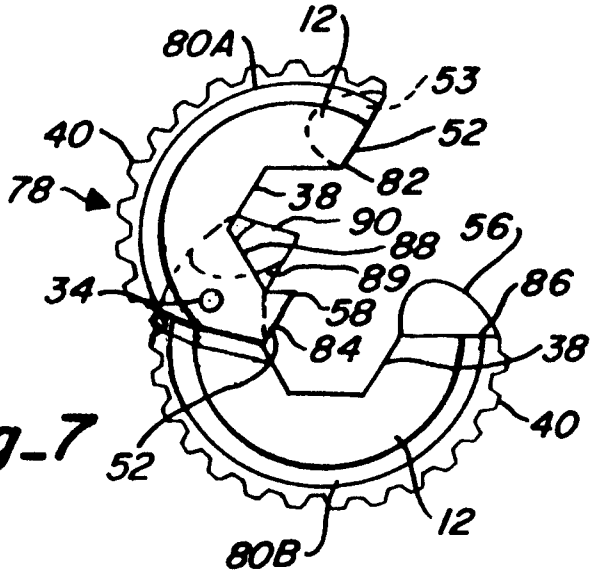
FIG. 7 is a side view of a second embodiment of the socket of this invention.

In FIG. 7, a second embodiment 78 of the peripherally driven composite socket includes two substantially "C" shaped parts, or segments, 80A and 80B each being formed with either a worm or spur geared annulus, or outer edge, 40. Segment 80A is bifurcated on each of its ends 82 and 84 to form two parallel spaced apart legs 52 (only one of which is shown) on each segment end forming two receiving slots 53. Projecting arcuate tongue member 56 at end 86 of segment 80B is engaged by slot 53 of end 82 of segment 80A when socket 78 is in the closed and locked position. Slot 53 of end 84 of segment 80A fits over arcuate radius 88 of projecting tongue 89 at end 90 of segment 80B near hinge 34 so that the socket can open and close freely.

The two arcuate "C" shaped segments are hinged in such a way that lower abutting portion 58 of segment 80A projects into the bore of the socket when the socket is in the open position forming a lever, pressure upon which by an element of conduit closes the socket. The socket (and drive assembly) is then moved axially along the conduit to encircling relation with the threaded fastener to be manipulated. When the socket encircles the fastener, the facets of the fastener lock the socket into the closed position and maintain the socket segments in mutual complementary relationship by trapping lever portion 58 (and overlapping portions 89 and 52 the inner edges of which abut the fastener) and maintaining it in flush relationship with the hexagonal bore defined by segments 80A and 80B in the closed position. This inhibits relative pivoting of the segments and totally negates the necessity for any form of external locking device for socket 78.

FIG. 9 shows a third embodiment 92 of the socket of this invention with a simpler means of joining the end segments thereof wherein the male and female members only overlap and do not interlock with each other and are held in mutual complementary position by holes drilled through the end members secured together with nuts and bolts which are flush mounted for clearing slot 48 of the wrench head during operation.

In using the above embodiments of the peripherally driven composite socket and drive assembly, first the peripherally driven composite socket with the correct geometry and size for the nut to be rotated is selected from a set covering an appropriate range of sizes. This socket is then inserted into slot 48 of housing 23 of the drive assembly. Boss projections 17 are engaged by rotating the threaded projection into position with a part thereof in guide channel 63 of the socket until they make contact with the bottom of channel 63 without binding against it. In the above disclosed embodiments there are three boss members that project through housing 23 at each side of slot 48 (for a total of six boss members). Once channel 63 is engaged, axle 22 projecting from the base of handle 50 is either manually or mechanically rotated until socket bisection line 44 (shown in FIG. 3 and generally defining the opening interface of the socket segments) is parallel to and above slot 48.

In the case of socket 15, in this position one half of the socket can be unlocked by moving the upper segment of the socket at right angles to the slotted head of the wrench (when the socket is in place in the slotted head as shown in FIGS. 1 and 2) so that segments 26A and 26B are no longer in planar engagement. By thus moving segment 26A, the upper socket half and its projections 28 are cleared from and thus escape their respective receivers 30 and the socket segment can be swung open on pivot 34. With the socket in the open position, the wrench is positioned axially to the section of conduit that has the flare nut to be manipulated and is maneuvered into position so as to allow the upper socket segment to be closed around the element of conduit and locked. Closing the socket is accomplished by rotating the upper socket segment downward until the male projections and female receivers are in complementary alignment and then pressing the two segments together until the segment ends are completely interlocked.

With the socket in locked position, the socket is moved axially with the element of conduit until the socket is maneuvered into position encircling the fastener with the fastener passing through center bore 38. Power is then applied to axle 22 in either a clockwise or counter clockwise direction which rotates the socket and fastener combination in the desired direction. The source of power can be manual, but an electric drill or robotic equipment is preferably utilized.

Once a fitting has been rotated free of its threads, the tool can be moved off the end without any requirement for again unlocking the socket. Of course, when installing or removing fasteners where there is no obstruction, no unlocking of the socket in order to place the socket on the fastener is required.

Worm gear drive assemblies of this nature develop significant mechanical advantages. Hence, a cylindrical shaft is utilized so that in the event a nut will not turn for any reason, the axle will spin in the jaw of the drill rather than cause damage to the fastener or its fixture by applying excessive torque.

The manner of using embodiment 78 of the peripherally driven composite socket is generally the same as described above, except that when the socket is opened on its pivot 34, segment end 84 of segment 80A projects into the bore of the socket defining lever portion 58. Then the socket and drive assembly combination are positioned axially with the element of conduit. When lever portion 58 of socket segment 80A makes contact with the element of conduit, segment 80A will close and slot 53 of end 82 of segment 80A will engage projecting tongue member 56. Once the socket is closed, the socket and wrench combination is moved axially along the element of conduit until the socket encircles the fastener.

With the socket in the encircled position around the fastener, the facets of the fastener maintain pressure on lever portion 58 (and overlapping portions 88 and 52) holding the segments in the locked position. Opening the socket is accomplished by moving the wrench and socket combination axially along the element of conduit until the fastener is no longer within the center bore of the socket. This removes the force on the lever portion and overlapping portions of the segments and allows the socket to swing open when pulled against the element of conduit.

Turning now to FIGS. 10 through 12, a fourth embodiment 95 of the socket is illustrated having first socket part 97 and second socket part 99 pivotably connected adjacent to ends 101 and 103, respectively, thereof by pivot pin 105. Parts 95 and 97, when in the closed position as illustrated in FIG. 10, together define bore 107 at inner edges 109 and 111 of parts 97 and 99, respectively, of a shape selected for use with the type of fastener to be manipulated, with part 97 alone preferably having sufficient arc at inner edge 109 to engage the work piece for manipulation thereof (in this case including all or potions of 5 facets of a hexagonal bore 107). Outer geared edge 113 is defined by the parts in the closed position and is configured for engagement with a drive assembly as discussed herein above or herein below (for example, a worm gear toothed configuration).

Guide channel 115 is formed in one or both of socket faces 117 of socket 95 by channel portions 119 and 121 in each of the parts for receipt therein of a guide member of the drive mechanism (such as the boss projections described herein above or an arcuate ridge as will be described herein below).

Projecting tongue portions 123 and 125 having a portion of inner edge 109 thereat are defined at part 97 adjacent to ends 101 and 127, respectively. Receiving portions 129 and 131, configured as spaced apart legs, are defined at ends 103 and 133, respectively, of part 99, with each leg of each receiver also forming a part of inner edge 111. As may be appreciated, when portions 123 and 129 are engaged and secured by pivot pin 105, the portions both abut the work piece at their overlap (as shown in FIG. 10), this arrangement, together with the location of pivot pin 105, being sufficient to substantially preclude relative pivotal movement of parts 97 and 99.

Portions 125 and 131, as before, are engaged when the socket is closed, with portion 125 being locked into position when edge 109 thereat is abutting the work piece thus avoiding spreading stresses which may in some cases be exhibited during use of the socket. Edge portions 135 and/or 137 again provide a self-closing lever. Matable arcuate edges 138 and 139 are provided to accomodate pivoting motion of the parts.

FIGS. 13 and 14 illustrate a now preferred embodiment of the drive assembly. Assembly 140 having socket 95 therein is connected with power driver 142 by flexible shaft 144. The drive assembly includes housing 146 having worm drive gear 148 mounted therein on shaft 150 with roll pin 152. Retractable positioning member 154 is slidably mounted on guide pins 156 connected with housing 146 and is biased outwardly therefrom by springs 158.

Slidable retainer 160 is mounted in dovetailed slot 162, dovetail 164 forming ledge 166 at the top thereof which is slightly lower than top edge 168 of the retainer. Retainer 160 is biased upwardly by spring 170 mounted between detent 172 and dovetail 164. Guide hole 174 and set screw 176 threaded into the housing limit travel of the retainer.

When retainer 160 is in the up position, with dovetail 164 abutting face 178 of positioning member 154, the positioning member is held adjacent to housing 146 with arcuate ridge 180 engaged in guide channel 115 of socket 95, thus securing and properly positioning the socket for engagement with, and thus rotation by, drive gear 148 (A similar guide ridge could be formed at back wall 182 of housing 146). When it is desired to change sockets, retainer 160 is manually moved downward, downward travel being limited to a position with ledge 166 level with top surface 184 of housing 164, so that positioning member 154 can retract under the influence of springs 158 to a position abutting the top of retainer 160 above dovetail 164. The socket may then be removed and replaced, member 154 being thereafter manually moved back into position abutting housing 146 and retainer 160 being urged back into securing contact with member 154 by spring 170.

Gear 148 and shaft 150 are held in place in housing 146 by threaded bushing 186 and end shaft bearing 188 both of which are secured to housing 146. Shaft 150 may be provided with configurations at its projecting end 190 suitable for attachment to appropriate driving tools (either manual or powered). A shaft driver connection could be provided at either or both ends of the shaft with appropriate reconfiguration of housing 146 and supporting bearings.

As may be appreciated, this invention can be utilized to quickly and easily remove threaded fasteners, and is particularly useful where these fasteners encircle elements of continuous conduit. The socket and drive assembly are easily manufactured through castings and other low cost manufacturing methods, allowing economical production of the tool.

While the description provides specific examples of the invention, modifications are of course possible. For example the projections and receivers of the composite socket could be a number of different shapes such as oval, trapezoidal, triangular or square, and arranged in any combination thereof. Additionally, the socket segment ends could be formed with many different types of interlocking projections and receivers, such as ball and detent or various latching arrangements. It should also be apparent that in some applications, the segments of the composite socket could be bolted or screwed together to prevent accidental opening of the socket from the locked position.

Further the boss projections of FIGS. 1, 2, 4 and 8 could be spring biased or cast into the slot of the wrench as a set of projecting radius or a combination of both. Also, the portion of axle portion 22 that extends beyond handle 50 could terminate in a fitting for engagement by a number of different hand tools such as conventional socket wrenches or pliers, or for engagement and utilization by robotic appendages. The axle could be any polygonal shape as well as cylindrical. The socket and drive assembly can be made of any suitably strong material, for example aluminum, steel, bronze or any number of strong rigid plastics or chemically produced stocks.

What is claimed is:

1. For use with a drive assembly, a socket engageable with the drive assembly for manipulating a work piece, said socket comprising:

a first part having an inner edge configured to abut the work piece, an outer edge configured to engage the drive assembly, and first and second ends, said first end of said first part having a projecting portion formed thereat;

a second part having an inner edge configured to abut the work piece, an outer edge configured to engage the drive assembly, and first and second ends, said first end of said second part having a receiving portion formed thereat; and pivot means pivotably connecting said first and second parts at a location adjacent to said second ends for accommodating relative movement of said parts between an open position and a closed position with said projecting portion of said first end of said first part received in said receiving portion of said first end of said second part, said second ends of said parts being configured so that, at least when the work piece is being manipulated, relative pivotal movement of said parts is substantially precluded as a result of said configuration of said second ends.

2. The socket of claim 1 wherein said parts have faces between said inner and outer edges, said faces having guide means thereat for engagement by the drive assembly.

3. The socket of claim 1 wherein said projecting portion is an arcuate head and wherein said receiving portion is an arcuate slot.

4. The socket of claim 1 wherein said projecting portion is a tongue and wherein said receiving portion includes spaced apart legs.

5. The socket of claim 1 wherein said inner edges of said parts are configured so that at least a portion thereof adjacent to said second ends of said parts and said pivot means overlap.

6. For use with a drive assembly, a socket engageable with the drive assembly for manipulating a work piece, said socket comprising:

a first part having an inner edge at least a first portion at one end and a second portion of which are configured to abut the work piece; and a second part having an inner edge at least a first portion at one end of which is configured to abut the work piece, said first and second parts being pivotably connected at a location adjacent to said ends so that said first portions of said edges, when abutting the work piece to be manipulated, overlap sufficiently to substantially preclude relative pivotal movement of said parts as a result of said overlap.

7. The socket of claim 6 wherein one of said ends defines a lever portion for causing relative pivotal movement of said parts when said lever portion is acted upon.

8. The socket of claim 6 wherein said second part has a second portion of said inner edge configured to abut the work piece, said second portions of said inner edges of said parts being configured to overlap.

9. The socket of claim 6 wherein said first and second portions of said inner edge of said first part are sufficiently spaced so that said first part alone is capable of engaging the work piece sufficiently for manipulation thereof.

10. The socket of claim 6 wherein said parts have outer edges spaced from said inner edges engageable with the drive assembly for rotation of said socket.

11. The socket of claim 10 further comprising pivot means for pivotably connecting said first and second parts, said location thereof being more adjacent said outer edges than said inner edges of said parts.

12. The socket of claim 6 wherein said first and second parts have matable arcuate end faces adjacent to said location.

13. A drive assembly for a socket engageable with said drive assembly comprising:

a housing;

driving means mounted in said housing for engaging and rotating the socket; and retractable positioning means mounted at said housing for enabling reception in said housing of the socket without disassembly of said drive assembly when in a retracted position relative to said housing and for securing and properly positioning the socket at said housing for rotation thereof when in a second position relative to said housing.

14. The drive assembly of claim 13 wherein said positioning means are boss projections.

15. The drive assembly of claim 13 further comprising a guide connected to said housing and having said positioning means retractably mounted thereon for movement relative to said housing.

16. The drive assembly of claim 15 further comprising biasing means for urging movement of said positioning means in one direction on said guide.

17. The drive assembly of claim 13 further comprising a shaft connected with said driving means in said housing and having an end capable of receiving a rotating tool.

18. The drive assembly of claim 13 wherein said positioning means includes an arcuate ridge engagable with an arcuate slot of the socket.

19. The drive assembly of claim 13 wherein said positioning means is retractable, said drive assembly further comprising a retainer movably mounted with said housing for allowing retraction of said positioning means in a first position and securing said positioning means against retraction in a second position.

* * * * *